US009570794B2

(12) United States Patent
Clayton et al.

(10) Patent No.: US 9,570,794 B2
(45) Date of Patent: Feb. 14, 2017

(54) SUPPORT APPARATUS FOR AN INFLATABLE ANTENNA

(71) Applicant: Cubic Corporation, San Diego, CA (US)

(72) Inventors: William R. Clayton, Huntsville, AL (US); Paul A. Gierow, Madison, AL (US)

(73) Assignee: Cubic Corporation, San Diego, CA (US)

( * ) Notice: Subject to any disclaimer, the term of this patent is extended or adjusted under 35 U.S.C. 154(b) by 379 days.

(21) Appl. No.: 13/846,087

(22) Filed: Mar. 18, 2013

(65) Prior Publication Data

US 2014/0266969 A1 Sep. 18, 2014

(51) Int. Cl.

| | |
|---|---|
| ***H01Q 1/08*** | (2006.01) |
| ***H01Q 1/14*** | (2006.01) |
| ***H01Q 15/16*** | (2006.01) |
| ***H01Q 19/13*** | (2006.01) |

(52) U.S. Cl.

CPC ..... *H01Q 1/082* (2013.01); *H01Q 1/14* (2013.01); *H01Q 15/163* (2013.01); *H01Q 19/13* (2013.01)

(58) Field of Classification Search

CPC ..... H01Q 15/20

USPC ..... 343/881, 878, 915, 766; 248/346.05

See application file for complete search history.

(56) References Cited

U.S. PATENT DOCUMENTS

| | | | | |
|---|---|---|---|---|
| 2,814,038 | A * | 11/1957 | Miller | H01Q 19/12 126/680 |
| 3,005,987 | A * | 10/1961 | Mack | H01Q 15/163 343/872 |
| 3,646,564 | A * | 2/1972 | Drislane | H01Q 1/125 343/766 |
| 5,638,913 | A | 6/1997 | Blum | |
| 5,826,121 | A * | 10/1998 | Cardellini | F16M 11/24 396/428 |
| 7,218,289 | B2 * | 5/2007 | Trajkovic | H01Q 3/08 343/757 |
| 7,309,106 | B2 | 12/2007 | Stallman | |
| 2008/0042921 | A1 | 2/2008 | Gierow et al. | |
| 2010/0052276 | A1 | 3/2010 | Brunner | |
| 2010/0277384 | A1 * | 11/2010 | Gierow | H01Q 1/082 343/766 |

* cited by examiner

*Primary Examiner* — Dameon E Levi
*Assistant Examiner* — Walter Davis
(74) *Attorney, Agent, or Firm* — Kilpatrick Townsend and Stockton, LLP

(57) ABSTRACT

A support apparatus for an inflatable communications antenna system includes a case the size of airline carry-on luggage that is dimensioned to store a deflated antenna and its accompanying power, control and inflation systems.

13 Claims, 2 Drawing Sheets

5
1
4A
9
2
3
25
4B
100
24A
8
22B
26
18C
24B
18B
6
7
19C
19B 5
1
2
22A
100
21A
21B
24A
24B
19A
18A
6
8
7
18B
19B

SUPPORT APPARATUS FOR AN INFLATABLE ANTENNA

BACKGROUND

Field

The present invention relates generally to inflatable antennas, more particularly, to a support apparatus for inflatable antennas.

BRIEF DESCRIPTION OF THE DRAWINGS

The present invention is described with reference to the accompanying drawings. In the drawings, like reference numbers indicate identical or functionally similar elements.

DETAILED DESCRIPTION

The various embodiments and their advantages are best understood by referring to FIGS. 1 through 4 of the drawings. The elements of the drawings are not necessarily to scale, emphasis instead being placed upon clearly illustrating the principles embodied in the apparatus.

The drawings represent and illustrate examples of the various embodiments of the apparatus, and not a limitation thereof. It will be apparent to those skilled in the art that various modifications and variations can be made without departing from the scope and spirit of the invention as described herein. For instance, features illustrated or described as part of one embodiment can be included in another embodiment to yield a still further embodiment. Moreover, variations in selection of materials and/or characteristics may be practiced to satisfy particular desired user criteria.

Furthermore, reference in the specification to "an embodiment," "one embodiment," "various embodiments," or any variant thereof means that a particular feature or aspect described in conjunction with the particular embodiment is included in at least one embodiment. Thus, the appearance of the phrases "in one embodiment," "in another embodiment," or variations thereof in various places throughout the specification are not necessarily all referring to its respective embodiment.

The support apparatus described herein is generally contemplated for use with an inflatable, portable antenna apparatus. For an example of such inflatable antenna apparatuses, please see U.S. Pat. No. 6,963,315, to Gierow, et al, which is incorporated herein by reference. An inflatable antenna apparatus as contemplated herein is essentially a two-chamber, gas-filled sphere where a partition between the two chambers is maintained the shape of a parabolic dish, or lenticular dish. The partition reflects energy to or from a feed horn assembly mounted in the surface of the sphere. The parabolic shape of the reflector may be maintained by having higher air pressure in the chamber on the reflecting side of the partition, than in the chamber on the opposing side.

Figure 1:
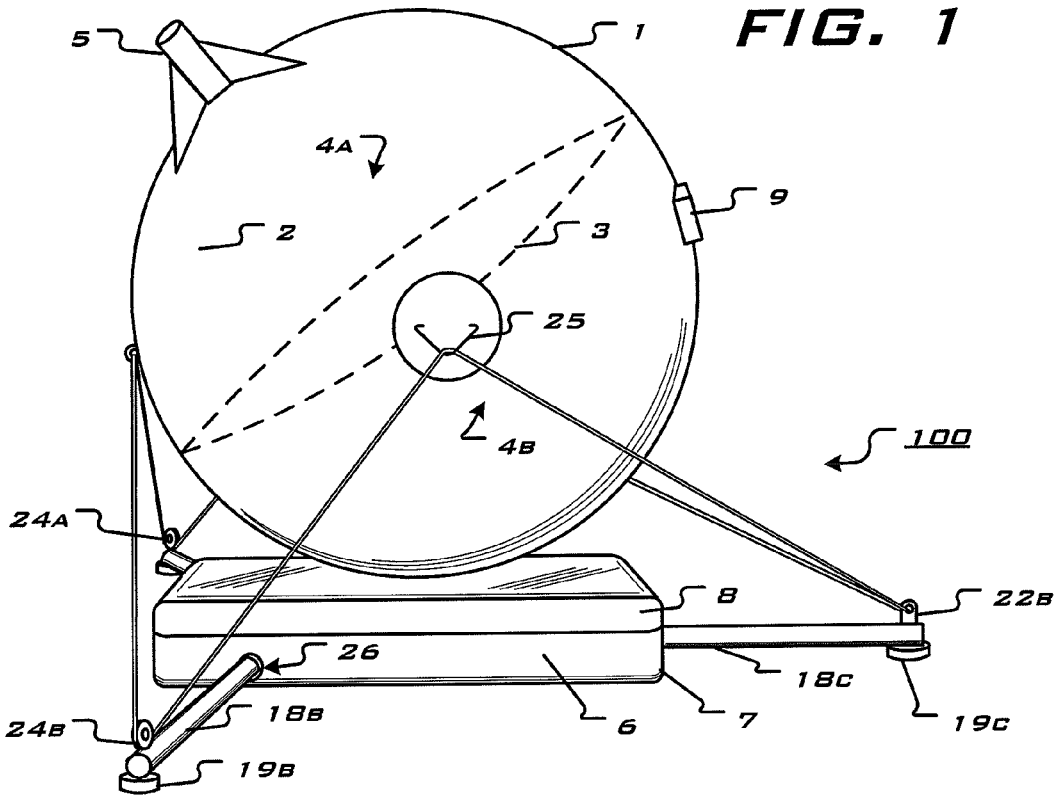
FIG. 1 is a side view of an inflatable antenna secured to an exemplary support apparatus.
Figure 2:
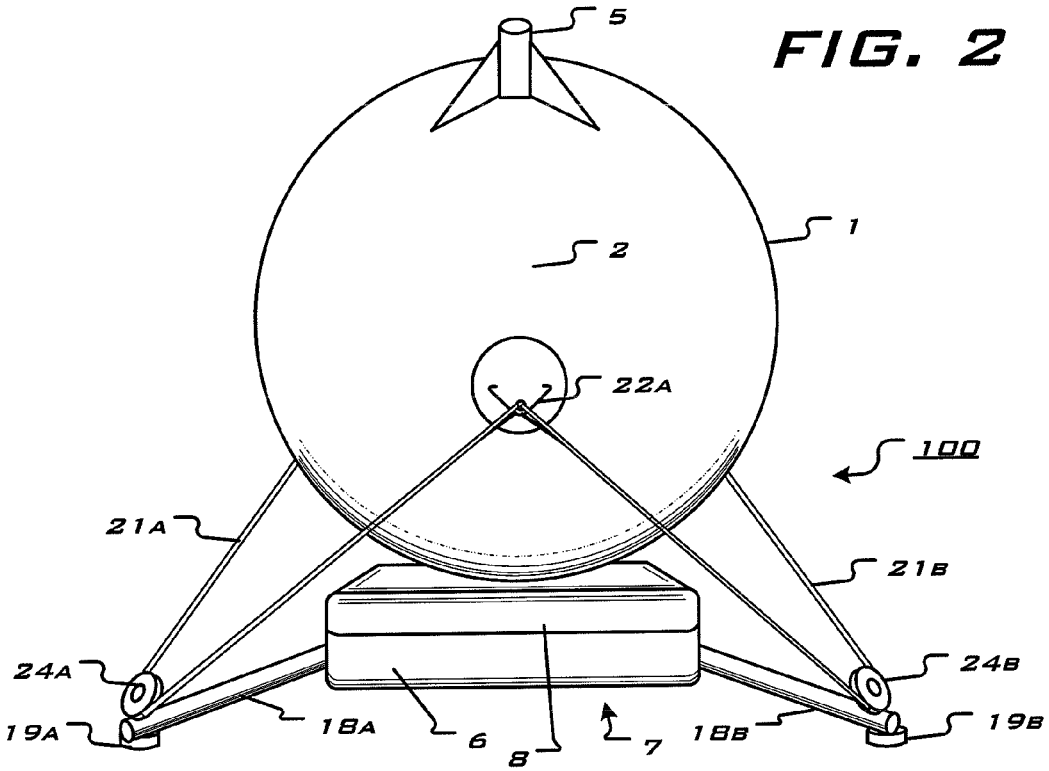
FIG. 2 is an end-on view of FIG. 1.
Figure 3:
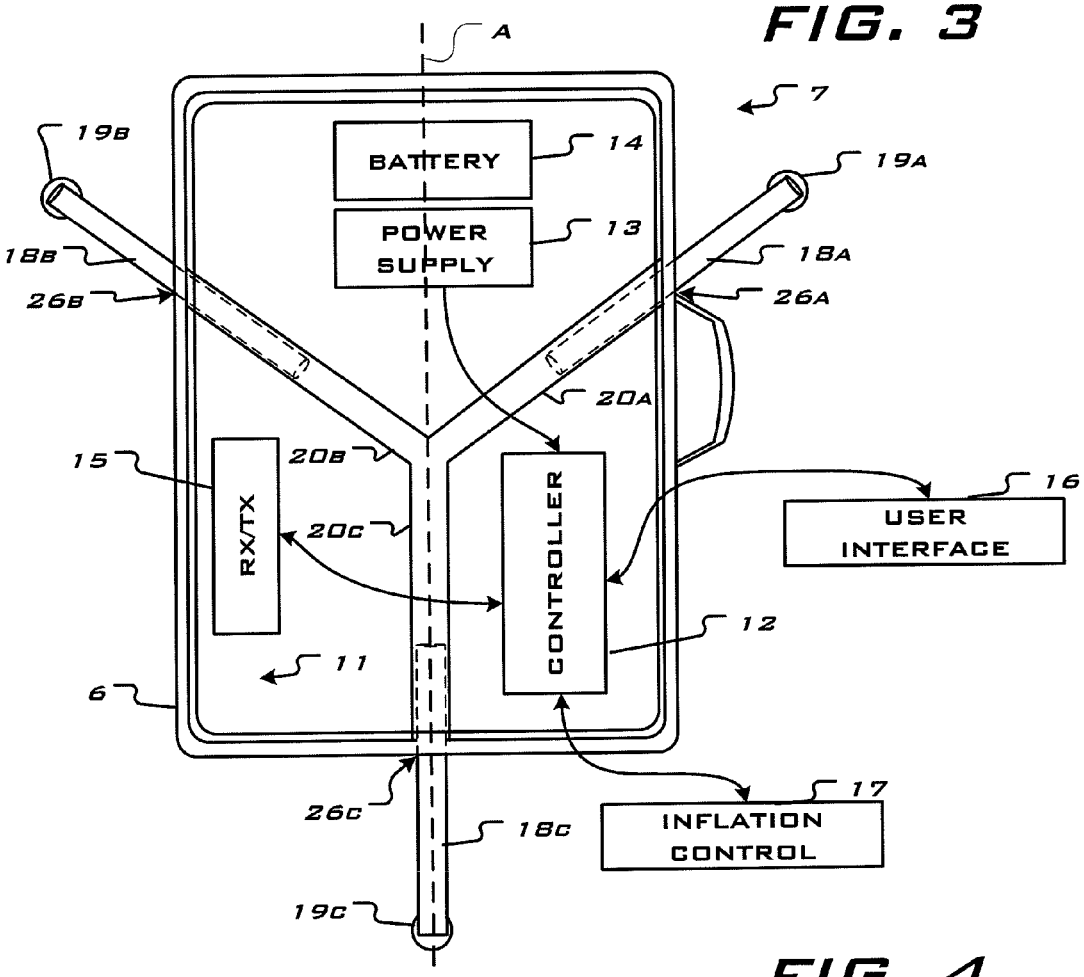
FIG. 3 depicts an interior chamber of the case.

FIGS. 1 through 3 illustrate an exemplary support apparatus 100 for an inflatable antenna 1. The antenna 1 includes a spherical inflatable shell 2 and a membrane 3 in the interior of the sphere roughly disposed at the interior equator. The antenna 1 is comprised of an upper 4*a* and lower chamber 4*b*, the upper chamber 4*a* having a slightly greater air pressure so as to maintain the membrane in a generally parabolic shape. A feed horn 5 is positioned on the outside surface of the sphere 2 and is located roughly at the focal point of the parabola created by the membrane 3. The membrane 3 is formed having an electromagnetic reflective surface oriented toward the feed horn 5. Consequently, the inflatable antenna 1 functions as parabolic antennas currently known in the art. The antenna 1 also includes a blower 9 in fluid communication with at least one of the chambers 4*a, b*, for inflating, and maintaining inflation of the antenna 1.

The antenna 1 rests upon, and is secured to, a case 7 comprising a box 6 and a lid 8 hingedly attached thereto and latchable when closed in the style of a suitcase or briefcase. The case 7 is dimensioned to be to define a space no greater than that defined by airline carry-on luggage. For example, case preferably defines a space less than about 24"×16"×10", and more preferably less than about 22"×14"×9". As shown in FIG. 3, the box 6 together with the lid 8 define a chamber 11 for housing a controller 12, a power supply module 13, a battery 14, and a transceiver 15. The controller 12 is a computer-based system configured to control operation of the antenna 1 system and is responsive to a user interface 16 and may include an inflation control module 17, which controls the blower 9 for maintaining proper pressure within the chambers 4*a, b*.

The apparatus 100 is configured with a plurality of legs 18*a-c*, extending outward from the case, and each comprising an elongated member with a foot 19 attached near the outer end of the elongated member to the underside thereof. The case 7 is adapted to include a plurality of hollow tubes 20*a-c* that open to respective apertures 26*a-c* defined in the walls of the case 7, and in which the legs 18*a-c* may be stowed and from which the legs 18*a-c* extend when the antenna 1 is deployed. In the illustrated embodiment, three legs 18*a-c* are depicted with two 18*a, b*, angled with respect to the long axis of the case (ref. line A) and one longitudinal leg 18*c*. However, it will be appreciated that other numbers of legs, and other orientations, may be used.

The antenna 1 is secured to the case with lines 21*a, b* extending along either hemisphere of the antenna 1, with first ends that a secured to an attachment point 22*b* located on the longitudinal leg 18*c*, and second ends secured to an attachment point 22*a* located on surface of the antenna 1, and with intermediate portions threaded through pulleys 24*a, b* located on the angled legs 18*a, b*, and/or through a hook or eye 25 attached to either lateral side of the antenna 1.

Figure 4:
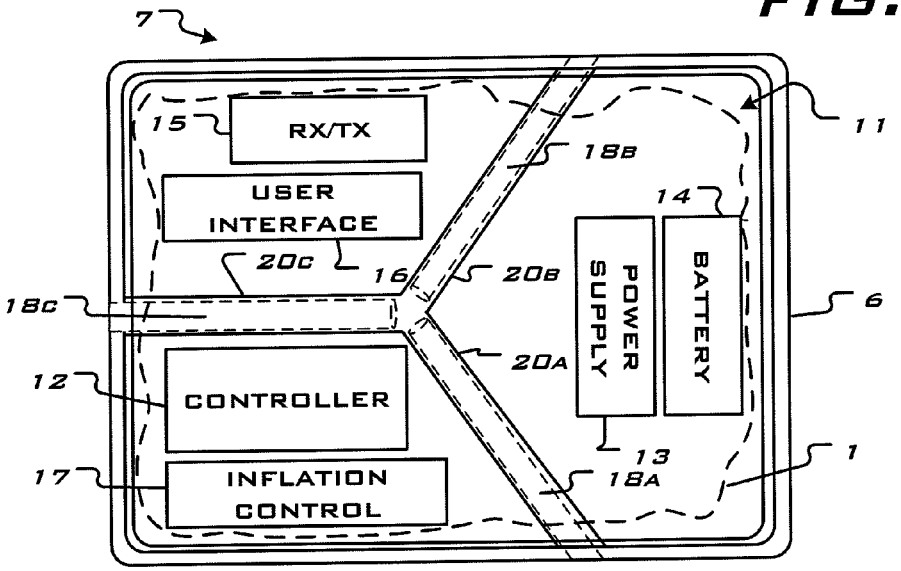
FIG. 4 is depicts the inter chamber with the antenna and control components stored therein.

The stowed condition of the antenna is illustrated in FIG. 4, with the legs 18*a-c* retracted within their respective hollow tubes 20*a-c*. The chamber 11 defines a volume sufficient to enclose the power, transmission and control components 12-17, but also the antenna 1 (shown in dashed line for clarity) along with the feed horn 5 (not shown for clarity).

As described above and shown in the associated drawings, the present invention comprises a support apparatus for an inflatable antenna. While particular embodiments of the invention have been described, it will be understood, however, that any invention is not limited thereto, since modifications may be made by those skilled in the art, particularly in light of the foregoing teachings. It is, therefore, contemplated by the appended claims to cover any such modifications that incorporate such features or those improvements that incorporate the novel principles embodied by the apparatus.

What is claimed is:

1. A support apparatus for an inflatable communications antenna system, said system including an inflatable antenna, a power module, controller and a transceiver, said apparatus comprising:

a case having a hingedly attached lid and defining a chamber for housing said antenna in a deflated state, said power module, controller and said transceiver, and comprising a plurality of hollow tubes coupled within the chamber, each of which have an opening defined in at least one exterior side wall of the case, wherein the at least one exterior side wall defines an outer periphery of the case; and a plurality of support legs slidably stowable within the hollow tubes within the case and telescopically extendable outwardly from within the case from said respective openings, each said support leg comprising an elongated member with a foot attached to an underside of an outer end thereof, wherein the plurality of support legs are configured to extend beyond the outer periphery of the case to support the case and the antenna when in an inflated state.

2. The support apparatus of claim 1, further comprising a plurality of lines for securing said antenna in an inflated state to said case.

3. The support apparatus of claim 1, wherein said plurality of hollow tubes comprises three hollow tubes and said plurality of support legs comprises three support legs.

4. The support apparatus of claim 3, wherein said case comprises a long axis, and wherein a pair of said hollow tubes are divergently angled with respect to each other.

5. The support apparatus of claim 4, wherein one hollow tube extends along said long axis.

6. The support apparatus of claim 5, further comprising a plurality of lines for securing said antenna in an inflated state to said case.

7. The support apparatus of claim 1, wherein said case defines a space no greater than about 26"×16"×10".

8. The support apparatus of claim 7, wherein said plurality of hollow tubes comprises three hollow tubes and said plurality of support legs comprises three support legs.

9. The support apparatus of claim 8, wherein said case comprises a long axis, and wherein a pair of said hollow tubes are divergently angled with respect to each other.

10. The support apparatus of claim 9, wherein one hollow tube extends along said long axis.

11. The support apparatus of claim 10, further comprising a plurality of lines for securing said antenna in an inflated state to said case.

12. An inflatable communications antenna comprising:

an inflatable antenna;

a power system;

a control system;

an inflation control system;

at least three stabilizing leg members; and a case for storing said antenna in a deflated state, said power, control and inflation control system, said case defining a space no greater than about 26"×16"×10" and including a chamber comprising three hollow tubes coupled within the chamber and comprising three stabilizing leg members telescopically coupled within a respective one of the three hollow tubes and extendable therefrom, wherein each of the three hollow tubes has an opening defined in at least one exterior side wall that defines an outer periphery of the case, and wherein the at least three stabilizing leg members are configured to extend beyond the outer periphery of the case to support the case and the antenna when in an inflated state.

13. The support apparatus of claim 2, wherein:

a first end of each of the plurality of lines is coupled to the inflatable antenna; and a second end of each of the plurality of lines is coupled with one of the plurality of legs at a position proximate the foot.

* * * * *